United States Patent [19]

Boeckmann

[11] Patent Number: 4,991,379

[45] Date of Patent: Feb. 12, 1991

[54] SUBSTANTIALLY FRICTIONLESS AND STATIC-FREE FORMER AND FEED TUBE

[75] Inventor: Hugo Boeckmann, Arlington Heights, Ill.

[73] Assignee: Zip-Pak Incorporated, Northbrook, Ill.

[21] Appl. No.: 552,854

[22] Filed: Jul. 13, 1990

Related U.S. Application Data

[63] Continuation of Ser. No. 341,471, Apr. 21, 1989, abandoned.

[51] Int. Cl.[5] ..... B65B 9/08

[52] U.S. Cl. ..... 53/552; 53/451; 53/551; 53/575

[58] Field of Search ..... 53/450, 451, 550, 551, 53/552, 554, 575, 576, 577

[56] References Cited

U.S. PATENT DOCUMENTS

| | | | |
|---|---|---|---|
| 2,200,360 | 5/1940 | Heres | 53/577 |
| 3,348,355 | 10/1967 | Jennings | 53/451 |
| 3,779,836 | 12/1973 | Henry et al. | 53/551 X |
| 4,442,656 | 4/1984 | Wylie, Sr. | 53/522 |
| 4,566,250 | 1/1986 | Matsumura et al. | 53/551 X |
| 4,617,683 | 10/1986 | Christoff | 53/551 X |
| 4,640,083 | 2/1987 | Takahashi et al. | 53/554 X |
| 4,709,533 | 12/1987 | Ausnit | 53/451 |
| 4,711,068 | 12/1987 | Dominguez | 53/551 |
| 4,922,361 | 5/1990 | Bordignon | 360/130.31 |

*Primary Examiner*—Robert L. Spruill
*Assistant Examiner*—Linda B. Johnson
*Attorney, Agent, or Firm*—Hill, Van Santen, Steadman & Simpson

[57] ABSTRACT

An apparatus for forming bags from a thin plastic film in a tube form fill operation wherein plastic film is fed over the outer surface of the tube and the edges of the film are joined to provide a bag tube and an antistatic friction reduction surface treatment is provided on the outer surface of the tube for encouraging sliding movement of the film and insuring uniform feed with the friction reducing and electrically insulating material in the form of a plastic coating or ribs to produce the desired result.

5 Claims, 1 Drawing Sheet

SUBSTANTIALLY FRICTIONLESS AND STATIC-FREE FORMER AND FEED TUBE

This is a continuation of application Ser. No. 341,491, filed Apr. 21, 1989, now abandoned.

BACKGROUND OF THE INVENTION

The present invention relates to improvements in making bags, and more particularly to making and filling bags from a continuous sheet of plastic film.

More particularly, the invention relates to an improved method in which completed packets or bags are formed by feeding a thin plastic film over a vertical filling tube to wrap the film around the tube. The edges of the film are joined and the film is pulled downwardly and cross-seals are made at the base of the film. Contents are dropped into the film tubing and a cross-seal is made above the contents and the completed bag is cut from the tubing. An example of this type of mechanism is illustrated in U.S. Pat. No. 4,709,533, Steven Ausnit, as well as in an earlier U.S. Pat. No. 4,617,683, Christoff.

In the formation of bags, the weight or thickness of the film depends upon the type of bag to be formed and the contents thereof. In very thin lightweight film, it is essential that the film is fed uniformly downwardly and this is particularly important where the edges of the film are to be brought together to form a seam along the axial length of the tube. As the thin film is drawn downwardly, it is important that it advance uniformly so that wrinkles are not formed in the film in order that the side seam can be uniformly made. It is also important that the film not be scuffed or torn and a snug wrap of the film around the tube is helpful in making a uniform bag, but this can increase the frictional resistance offered by the outer surface of the tube. This is particularly important in high speed production where the film must be drawn rapidly down over the filling tube and stopped when a cross-seal is made and again quickly pulled downwardly for the next length of film to form the next bag.

In the formation of certain bags, multilayer laminated layer film is used. This film may be composed of different layers of plastic, but frequently includes a layer of metallized film or aluminum foil. This type of film will generate high static charges when fed downwardly over the hollow tube. This has resulted in the necessity of providing a static eliminator, which does not entirely solve the problem. Further, in many cases, the static eliminator is removed or damaged by careless operators. On occasions, complete feed blockage has been experienced with highly charged aluminum foils on days with very low humidity.

It is accordingly an object of the present invention to improve the formation of bags in a form fill process wherein the frictional resistance offered by the filling tube is substantially reduced to insure uniform feed of the plastic film without wrinkling or puckering.

A further object of the invention is to provide an improved form fill machine wherein the plastic film can be formed and drawn more smoothly and evenly than in devices heretofore available.

A still further object of the invention is to provide a new and improved bag-making method in a vertical form, fill machine wherein the generation of static electricity over the feed tube is avoided.

FEATURES OF THE INVENTION

In the present arrangement, a filling tube is provided over which a continuous length of plastic film is wrapped and formed with the edges of the film brought around the filling tube and joined to form a side seam. The film is drawn down in lengths and each length is cross-sealed and contents are dropped into the thus formed bag tube through the filling tube. A cross-seal and cut is formed above the contents to complete the bag.

The outer surface of the filling tube is provided with a friction reducing means which takes various forms. In one form a plastic coating such as Teflon is formed over the outer surface of the filling tube, and in another form with or without the additional plastic coating, ribs are formed on the surface of the tube to reduce the area of contact. The ribs extending parallel to the axis of the tube additionally guide the film and hold it against skewing. Other forms of friction reducing means are provided such as by cutting grooves or by surface inserts.

The outer surface of the filling tube is provided with a surface material which eliminates the possibility of the formation of high static charges. A non-metallic plastic coating is formed over the outer surface of the filling tube thereby eliminating the formation of high static charges and eliminating the possibility of feed blockage which has been experienced with highly charged foil layered film, particularly on days with very low humidity. Static eliminators have been necessary with devices heretofore used and the provision of a non-static forming surface means avoids the need for a static eliminator.

Other objects and advantages will become more apparent with the teaching of the principles of the invention in connection with the disclosure of the preferred embodiments thereof in the specification, claims and drawings, in which:

DESCRIPTION OF THE PREFERRED EMBODIMENTS

Figure 1:
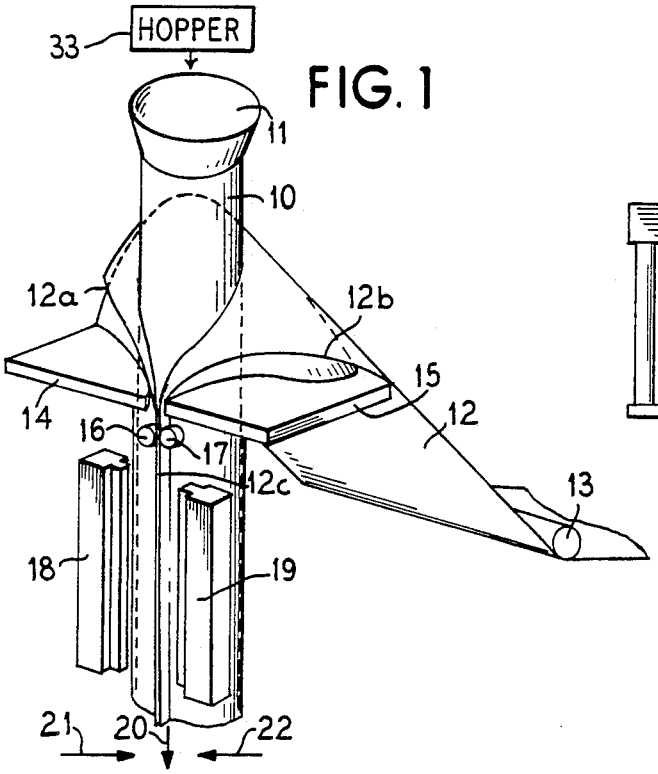
FIG. 1 is a perspective view shown in somewhat schematic form of a form fill apparatus constructed and operating in accordance with the principles of the present invention.

As illustrated in FIG. 1, a hollow filling tube 10 is provided having an enlarged portion 11 at the top through which goods can be fed from a container or hopper 33 to descend into a bag formed at the lower end of the tube.

To form a bag, a thin lightweight film 12 is fed forwardly in a continuous strip from a supply roll, guided by a roller 13. The film 12 is shaped or formed over the tube 10.

For guiding the thin lightweight plastic film, shoulders 14 and 15 are positioned to wrap the film around the outer surface of the tube 10 and to bring the film edges 12*a* and 12*b* together to form a seam 12*c*.

To aid in the seam forming operation, pinch rollers 16 and 17 press the seam together, and these rollers may be heated in the case wherein the film is a thermoplastic such as polyethylene.

Pressing the edges 12*a* and 12*b* together with the heated rollers 16 and 17 will form a seam so that a bag tubing results. The seam may be formed such as by heat bars 18 and 19 which can be brought together and insure that the edges are joined to form the seam 12*c*.

Suitable means are provided for pulling the film downwardly incrementally for bag lengths and different mechanism may be employed for this such as bars which move together, grip the film and pull it downwardly. The gripping bars are indicated schematically by the arrowed lines 21 and 22 which have a downward movement as indicated by the arrowed line 20 after they have been applied to the surface of the film to squeeze it and seal it. After a cross-seam is formed in this manner, the contents are dropped into the bag tubing from the container 33 and the sealing bars 21 and 22 move apart and upwardly and then move toward each other to form a seal above the bag contents.

As will be seen with each operation of the sealing bars 21 and 22, the film is stopped and again pulled down, and in high speed operation, the acceleration is substantial. It is, thus, important that the film advance easily and rapidly with minimum drag against the outer surface of the filling tube 10. For the purposes illustrated in FIG. 1, the tube 10 is covered with an outer coating of a friction reducing plastic. One form of plastic which may be used is polytetrafluorethylene known as Teflon or a nylon.

Figure 2:
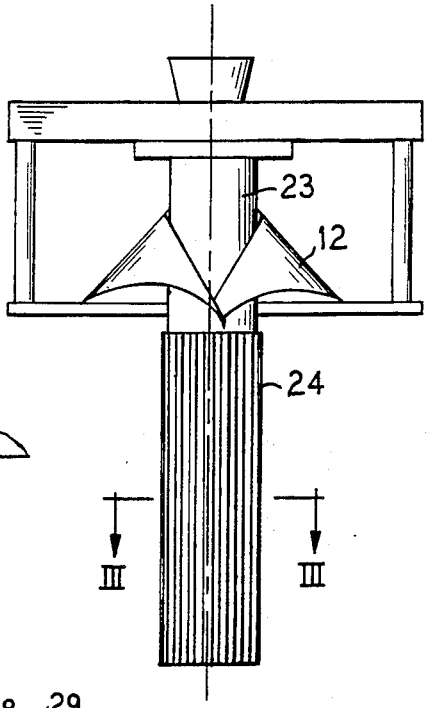
FIG. 2 is an elevational view of the mechanism of FIG. 1 with portions removed for the purposes of clarity.

FIG. 2 illustrates another form of tube wherein the plastic film 12 is drawn forwardly and fed to be wrapped over a filling tube 23. The major portion of the filling tube over which the film travels after the edges are brought together is shown at 24 and is constructed so as to reduce the frictional area of contact between the film and the outer surface of the tube.

A significant feature of the invention is the ability to feed film of any composition, such as that having metallized film or aluminum foil in the lamination. Normally, this type of film will create high static charges. With the provision of the static preventing outer surface of the tube, the generation of high static charges is eliminated. Various forms of coating will accomplish this purpose, but the provision of a non-conductive or insulating plastic coating is utilized to prevent the generation of the static charges.

Figure 3:
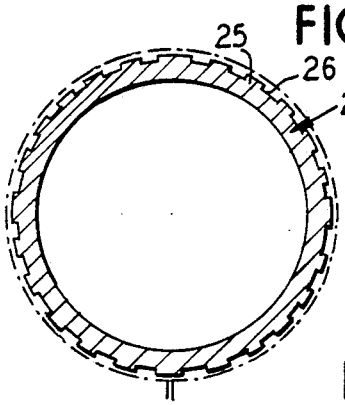
FIG. 3 is a somewhat enlarged horizontal sectional view taken substantially along line III—III of FIG. 2.

As illustrated in FIG. 3, the tube which is generally formed of a metal such as aluminum or stainless steel is milled with grooves 26 in the surface to provide vertically extending ribs 25. These ribs or lands extend axially in the direction of the film movement parallel to the axis of the tube and reduce the area of contact between the film and the outer surface of the tube 24. Also, the grooves 26 and the ribs therebetween 25 guide the film in its downward movement insuring that the film will advance straight axially and this aids in the formation of a reliable vertical seam such as shown at 12*c* in FIG. 1. While the provision of the grooves and ribs as shown in FIG. 3 reduces the surface area of contact, and therefore improves the forward movement of the film, the lands 25 additionally may be coated at their outer surface with a plastic such as Teflon. The Teflon is utilized because it provides both static prevention and low friction resistance.

Figure 4:
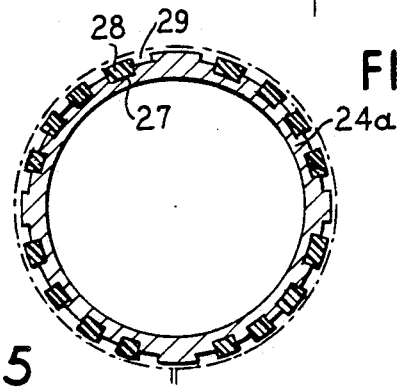
FIG. 4 is another somewhat enlarged horizontal sectional view taken substantially along line III—III of FIG. 2 and illustrating a modified form of the invention.
Figure 5:
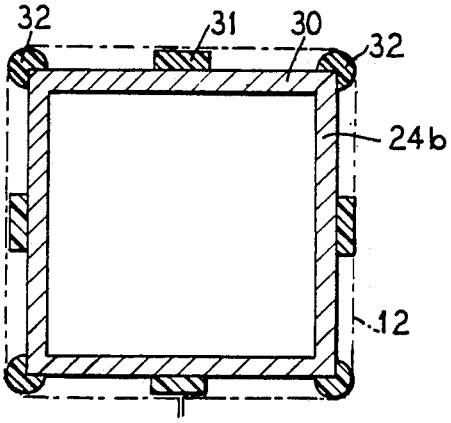
FIG. 5 is another somewhat enlarged horizontal sectional view taken along line III—III of FIG. 2, but illustrating still another form of filling tube.

FIG. 4 illustrates another form wherein a metal tube 24*a* is manufactured with vertically milled grooves 27 extending axially down the outer surface. In each of the grooves is a vertical bar insert 28 of a material which has a low frictional resistance to the plastic film. The film is thus guided in its vertical movement and slides easily over the material of the inserts 28 which may be of a very slippery material such as Teflon.

In FIG. 4 is illustrated a vertical filling tube 24*b* which is rectangular in shape. Applying the principles of the invention, means are provided for reducing the friction of film as shown by the broken line 12. Vertical ribs or guide bars of different shape are provided on the outer surface of the filling tube 24*b*. At the corners are guide bars 32 which have an arcuate or rounded outer shape so that the film will slide easily thereover. Between the outer corners are flat guide bars 31 which also offer the film with the surface of a low coefficient of friction.

Thus, it will be seen I have provided an improved device and method for forming bags using the form fill concept wherein higher speed operations can be attained and more uniform production and more uniform bags.

I claim as my invention:

1. In an apparatus for making form fill plastic film bags, said apparatus having a hollow supply tube arranged to receive a continuous length of plastic film, means for supplying film to be wrapped around the tube, guide means for wrapping the film onto the tuber over a portion of the outer surface of said tube, means for downwardly drawing said film over said tube surface, means for joining the edges of the film to form an axial seal to complete a bag tube, means for delivering goods to the tube interior to flow into the bag tube, means for cross-sealing the bag tube before and after said goods are delivered thereto, and means for severing a filled and cross-sealed bag from said bag tube, the improvement comprising:

said supply tube having a plurality of slots therein extending axially along said portion of said outer surface;

a plurality of ribs consisting of friction-reducing and anti-static material respectively disposed in said slots and extending along the entire axial length of said portion of said outer surface of said tube, said ribs projecting radially from said slots beyond said outer surface of said tube, and said slots and said ribs therein being substantially uniformly distributed around the circumference of said outer surface of said tube so that as said film is drawn over said surface of said tube said film is in contact substantially only with said ribs.

2. The improvement of claim 1 wherein said ribs consist of polytetrafluoroethylene.

3. The improvement of claim 1 wherein said ribs consist of nylon.

4. The improvement of claim 1 wherein said tube is circular.

5. The improvement of claim 1 wherein said tube is rectangular.

* * * * *